United States Patent [19]

Curtis et al.

[11] Patent Number: 4,514,995

[45] Date of Patent: May 7, 1985

[54] KNIT COVER FOR BEVERAGE CONTAINER

[76] Inventors: James J. Curtis; Edward A. Bourgo, both of 6604 N. Mississippi Ave., Portland, Oreg. 97217

[21] Appl. No.: 512,158

[22] Filed: Jul. 8, 1983

[51] Int. Cl.[3] ..... D04B 9/06; B65D 37/00; B65D 65/02

[52] U.S. Cl. ..... 66/170; 66/200; 150/52 R; 215/100 R

[58] Field of Search ..... 66/170, 196, 197, 200; 150/52 R; 215/100 R

[56] References Cited

U.S. PATENT DOCUMENTS

| | | | |
|---|---|---|---|
| 868,963 | 10/1907 | Bruebach | 215/12 R |
| 890,284 | 6/1908 | Kintz | 215/12 R |
| 890,903 | 6/1908 | Hawley | 215/12 R |
| 1,018,134 | 2/1912 | Scott | 66/196 X |
| 1,020,269 | 3/1912 | Domnick | 215/12 R |
| 1,519,034 | 12/1924 | Livingston | 215/12 R |
| 1,986,256 | 1/1935 | Ellis | 150/52 R |
| 2,035,384 | 3/1936 | Hinchliff | 66/170 X |
| 2,115,654 | 4/1938 | Swofford | 150/52 R X |
| 2,183,862 | 12/1939 | Davis, Jr. | 66/172 E |
| 2,685,319 | 8/1954 | Swasko | 150/52 R |
| 2,706,571 | 4/1955 | Ryan | 215/100 R X |
| 2,774,471 | 12/1956 | Williams | 66/170 X |
| 2,847,842 | 8/1958 | Almen | 66/200 X |
| 2,981,086 | 4/1961 | Ludwig | 66/200 X |
| 3,473,682 | 10/1969 | Studen | 150/52 R X |
| 3,727,659 | 4/1973 | Shuford | 66/170 X |
| 4,196,534 | 4/1980 | Shibamoto | 66/170 X |
| 4,282,279 | 8/1981 | Strickland | 150/52 R |
| 4,293,015 | 10/1981 | McGough | 150/52 R |

FOREIGN PATENT DOCUMENTS

| | | | |
|---|---|---|---|
| 533401 | 5/1955 | Belgium | 215/12 R |
| 292280 | 1/1932 | Italy | 215/12 R |
| 436055 | 10/1935 | United Kingdom | 215/12 R |

*Primary Examiner*—Wm. Carter Reynolds

*Attorney, Agent, or Firm*—Bell, Seltzer, Park & Gibson

[57] ABSTRACT

A knit cover for receiving a beverage container is disclosed which is formed as a single piece seamless rib knit sleeve having an integrally knit outwardly bulging band encircling the upper medial portion of the sleeve for aiding in preventing slipping of the cover through the hand of the holder of the beverage container, and for providing a decorative appearance. The knit cover acts as a heat insulating sleeve, and the lower or bottom portion thereof conforms to and underlies at least the outer peripheral portion of the bottom of the beverage container to act as a coaster for the container. The knit cover may be economically knit on a circular rib knitting machine, and readily folds or flattens so it may be economically shipped and easily stored while not in use.

9 Claims, 7 Drawing Figures

KNIT COVER FOR BEVERAGE CONTAINER

FIELD OF THE INVENTION

The present invention relates to a knit cover for beverage containers, which is adapted to act as an insulating sleeve to maintain the temperature of the beverage in the container, and to reduce the rate of exchange of heat between the hand of the user and the container. The cover also is adapted to function as a coaster for the beverage container.

BACKGROUND OF THE INVENTION

Beverage container covers of the above general type are known in the prior art. Many of these prior art container covers have been molded of a rubber or plastic material and of a shape and size to fit a particular shape and size of beverage container. For example, the Swasko U.S. Pat. No. 2,685,319 discloses a baby bottle protector of sponge rubber material and the Ryan U.S. Pat. No. 2,706,571 discloses a similar device constructed of somewhat harder rubber material. The container enclosures of these patents are bulky and costly to ship, and they are not easy and convenient to store by a user when not being used. Also, these container enclosures have very little stretchability and are made to accomodate only one particular type of container.

It has also been proposed that covers for beverage containers be formed of expanded polyurethane foam material. Such a cover is disclosed in Studen U.S. Pat. No. 3,473,682. However, this cover is also bulky and has limited stretchability so that it will accomodate only a limited number of different types of beverage containers.

Several types of knit covers for glasses, bottles and the like are shown in Hinchliff U.S. Pat. No. 2,035,384. The covers disclosed in this patent may be of a rib or plain knit construction and an elastic yarn may be inlaid in courses of the fabric for causing the cover to grip the receptacle encompassed thereby. The covers or jackets of the Hinchliff patent are in the form of a seamless tubular knit sleeve which may include decorative coursewise or walewise extending designs but the knit sleeve is otherwise substantially smooth on its outer surface so that the container may have a tendency to slip from the hand of the user.

SUMMARY OF THE INVENTION

The knit cover of the present invention overcomes these and other disadvantages of the prior known covers by providing a knit cover in the form of a knit sleeve of material having inherent stretchability and heat insulating properties. The sleeve may be flattened and folded so that it can be easily stored when not in use, and it is sufficiently stretchable so that it can be used to cover a wide variety of shapes and sizes of beverage containers.

In order to prevent slippage from the hand when placed on a beverage container, an outwardly bulging hand engagable annular band is formed around the upper medial portion of the sleeve. This band is formed during the knitting of the sleeve and is produced by holding the stitch loops on one set of needles while knitting several courses of stitch loops on the other set of needles, and then again knitting on both sets of needles.

The present knit cover also has a uniform bottom portion which is adapted to partially enclose the flat bottom of a beverage container which is slidably inserted in the sleeve. This bottom portion is formed by discontinuing the ribbed pattern and providing a non-elastic lower terminal edge opening. This lower opening has a diameter which is smaller than the upper opening, and the lower opening preferably does not stretch as much as the remainder of the sleeve when a container is inserted therein. This prevents the beverage container from slipping out of the lower end of the sleeve while at the same time functioning as a coaster having a substantially uniform bottom portion, which, having no irregularities, is unlikely to cause the container to tip over and spill its contents.

The knit cover may be economically formed on a circular knitting machine having two sets of needles and capable of knitting a seamless tube or sleeve of rib fabric, preferably in a one-by-one rib pattern. This pattern is continued for approximately one and one half inches or twenty to thirty courses in a preferred embodiment, and then the needles knitting the inwardly facing stitch loops hold their stitch loops while the needles knitting the outwardly facing or plain stitch loops continue to knit for about three to eight courses, to form the outwardly bulging band. All needles then again knit and the rib pattern is continued to an overall length of between about six to seven inches. The diameter of the knit cover of the present invention is dependent in part upon yarn weight, the tension used, the diameter and gauge of the machine, and the number of stitch loops formed in each course. Working with a sport or worsted weight acrylic fiber yarn, and a one-by-one rib knit pattern, a machine provided with 60 needles produces an appropriate diameter for the knit cover.

Yarn of acrylic fiber is preferred due to its inherent elasticity and heat insulating characteristics, although yarns of polypropylene, 100% wool, or wool blends may be used. It has been found that for optimum performance, a one-by-one rib knit stitch pattern in a sport or worsted weight yarn of acrylic fiber provides the best combination of inherent elasticity or stretchability and heat insulating properties. To provide greater elasticity, elastic yarn, such as spandex, may be laid in the courses of stitch loops in the top portion as well as in other portions of the knit cover.

The knit cover of the present invention is preferably formed of a seamless rib knit sleeve of successive courses of stitch loops knit of yarn having inherent yarn insulating properties, and including alternate wales of stitch loops facing inwardly and intervening wales of plain stitch loops facing outwardly. The seamless rib knit sleeve includes an upper tubular section with an upper selvage opening having elastic yarn incorporated therein for surrounding and engaging the peripheral surface of a container placed in the sleeve. The outwardly bulging band is integrally knit with the lower end of the upper tubular section, and the sleeve further includes a lower tubular section having an upper edge integrally knit with the lower end of the band. The bottom portion of the lower tubular section forms an essentially uniform bottom surface, with a lower non-stretchable or non-elastic lower selvage opening of reduced diameter so that the bottom portion is adapted to underlie and conform to at least the outer peripheral portion of the flat bottom of the container. The bottom portion thus also functions as a coaster for the container.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENT

Figure 7:
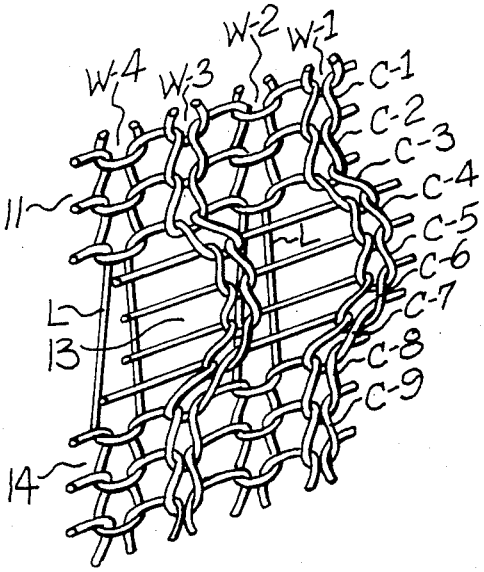
FIG. 7 is a greatly enlarged and somewhat schematic isometric view of a small fragmentary portion of the cover showing the stitch loop construction in the outwardly bulging annular band, and the immediately adjacent portions of the upper tubular section and lower tubular section.

Referring more particularly to the drawings, a preferred embodiment of the invention is illustrated which comprises a knit cover, broadly indicated at 10, which is in the form of a seamless rib knit sleeve of successive courses knit of yarn having inherent heat insulating properties. As best seen in FIG. 7, the seamless rib knit sleeve is preferably knit of a one-by-one knit rib construction with alternate wales of stitch loops facing inwardly (wales W-2 and W-4) and with intervening wales being formed with plain stitch loops facing outwardly (wales W-1 and W-3) so that the entire length of the sleeve has inherent coursewise stretchability.

Figure 2:
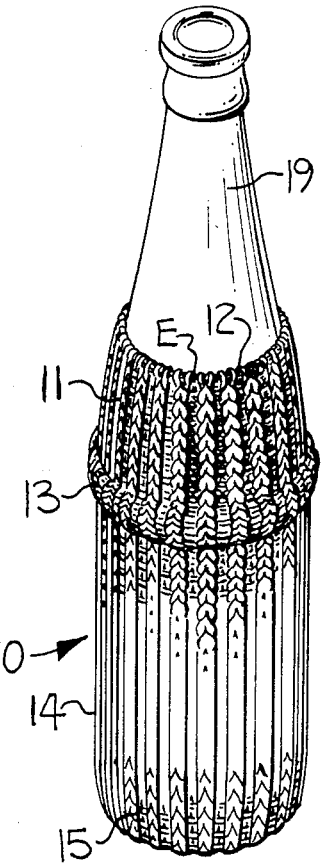
FIG. 2 is a perspective view of the knit cover positioned on a tall beverage bottle.
Figure 3:
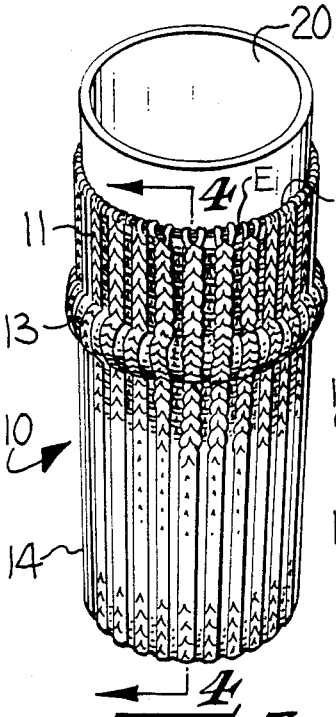
FIG. 3 is a perspective view of the present knit cover positioned on a drinking glass or tumbler.
Figure 4:
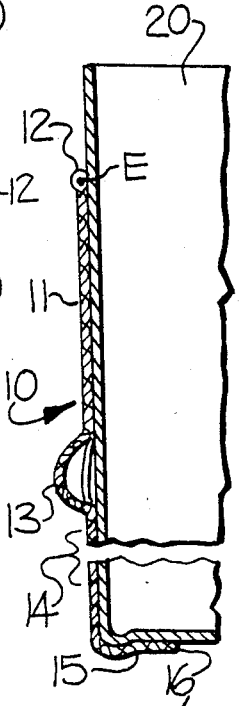
FIG. 4 is a fragmentary vertical sectional view taken substantially along the line 4—4 in FIG. 3 and illustrating the manner in which the cover conforms to the configuration of the container.

The knit cover 10 includes an upper tubular section 11 with an upper selvage opening 12 preferably containing an inlaid elastic yarn E. The upper selvage opening 12 may be formed in the usual manner of forming a makeup on a hosiery knitting machine with the stitch loops of the initial course surrounding one or more rounds of elastic yarn. The upper tubular section 11 is adapted to surround and engage the peripheral surface of the upper portion of a container placed in the sleeve, as illustrated in FIGS. 2–4.

An outwardly bulging hand engagable annular band 13 encircles the sleeve and is integrally knit with the lower end of the upper tubular section 11. The coursewise extending band 13 provides a decorative appearance, and also aids in preventing slippage of the cover through the hand of a holder when a beverage container is received in the sleeve. A lower tubular section 14 is provided with an upper edge portion which is integrally knit with the lower edge of the band 13, and it has a length sufficient to accommodate manual gripping of the lower tubular portion when placed on a beverage container.

Figure 1:
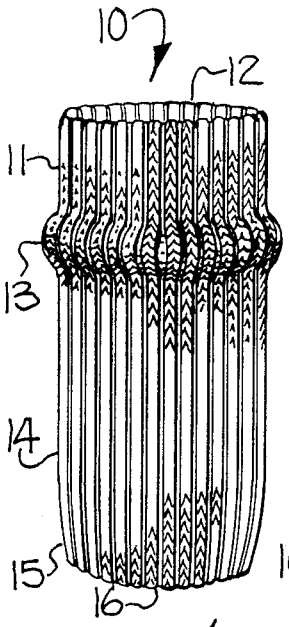
FIG. 1 is a perspective view of the knit cover of the present invention.

The lower section 14 includes a bottom portion 15 and a circular, preferably non-elastic lower selvage opening 16. The diameter of the opening 16 is substantially less than the diameter of the remaining portions of the sleeve, so that the bottom portion 15 is somewhat drawn together as best seen in FIG. 1. Also, the bottom portion 15 is adapted to conform to and underlie at least the outer peripheral portion of the flat bottom of the beverage container inserted therein, note FIG. 4. The non-elastic lower selvage opening 16 prevents the beverage container from slipping through the sleeve, while the bottom portion 15 thus also forms a coaster supporting the bottom of the beverage container when placed on a table or the like.

As best seen in FIG. 1, the lower section 14 has a length which is at least twice, and preferably about three times the length of the upper section 11. Thus in the preferred embodiment, the band 13 is spaced from the upper opening 12 a distance of between one-third to one-fourth the overall length of the sleeve. Typically, the sleeve has an overall length of between about six to seven inches, and a relaxed diameter of about two inches, with the lower selvage opening 16 having a diameter of about one and one quarter inches.

The knit cover 10 is shown positioned on a relatively tall beverage bottle 19 in FIG. 2. It will be noted that the upper tubular section 11 is resiliently engaging and conforms to the inwardly tapered upper section or neck of the bottle 19 while the outwardly bulging band 13 aids in preventing the slipping of the cover and the beverage container 19 through the hand of the holder. The lower tubular body section 14 is of a sufficient length to accommodate manual gripping of the lower tubular portion 14 when lifting or holding the beverage container 19.

The knit cover 10 is illustrated in position on a tapered drinking glass 20 in FIG. 3 and the upper tubular section 11 is in resilient engagement with the upper portion of the glass 20. The band 13 extends outwardly from and encircles the sleeve and the glass 20, and again aids in preventing slipping of the cover through the hand of the holder when the cover 10 is manually gripped in the area of the lower tubular section 14. The bottom portion 15 extends inwardly beneath the outer peripheral portion of the glass 20 (FIG. 4) and the non-elastic lower selvage opening 16 prevents slipping of the glass 20 through the cover 10. The bottom portion 15 further provides a coaster on which the glass 20 sits when the beverage container or glass 20 is positioned on a table or the like.

Figure 5:
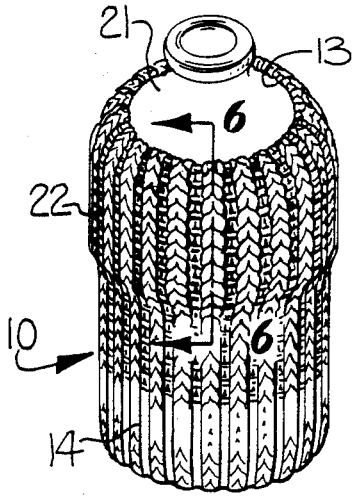
FIG. 5 is a view similar to FIG. 2 but showing the upper portion of the knit cover folded inwardly and with the cover positioned on a short beverage bottle.
Figure 6:
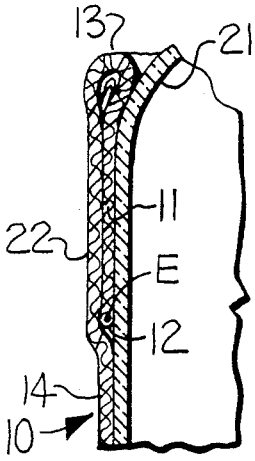
FIG. 6 is an enlarged fragmentary vertical sectional view taken substantially along line 6—6 in FIG. 5.

The cover 10 is illustrated in position on a short beverage bottle 21 in FIG. 5 and the upper tubular section 11 is shown folded down inside of the sleeve with the band 13 providing the upper terminal edge of the cover 10. When the upper tubular section 11 is folded downwardly inside of the knit cover 11, as best seen in FIG. 6, the lower terminal edge thereof forms a ridge or bulge, indicated at 22, surrounding the cover for aiding in preventing slipping of the cover 10 through the hand of the holder of the short bottle 21.

The knit cover 10 may be economically knit in a single piece manner on a circular knitting machine having two sets of needles and capable of knitting a seamless tube or sleeve of rib fabric, preferably a one-by-one rib pattern, as specifically illustrated in FIG. 7. The knit cover 10 is preferably knit from the upper selvage opening 12 to the lower selvage opening 16, and one knit cover may be knit continuously with succeeding knit covers in a "string-work" manner or each knit cover 10 may be individually knit and withdrawn from the knitting machine. In this instance, the upper selvage opening is preferably formed in the usual manner of forming a makeup on a sock while the lower selvage opening 16 may be rendered nonelastic by an overedge seam formed therearound or by unraveling some of the yarn in the last course and passing this yarn through all of the terminal loops and drawing the yarn inwardly until the desired size or diameter of terminal opening has been formed. The closing yarn is then tied off and the end is threaded into the fabric on the inside. In any event, a non-elastic lower selvage opening is formed which is substantially uniform and flat and will not permit the container to slip through the bottom of the sleeve.

Referring again to the specific embodiment shown in FIG. 7, the outwardly bulging band 13 includes alternate wales of inwardly facing held stitch loops and intervening wales of a plurality of courses of outwardly facing stitch loops. More particularly, the band 13 is preferably formed by holding the inwardly facing purl stitch loops in the last course of the upper tubular section 11, as illustrated by the loops L in wales W-2 and W-4, while knitting courses C-4 through C-7 on only the needles forming the outward or plain stitch loops in wales W-1 and W-3 and floating the yarn across the held purl stitch loops L formed in course C-3. All needles again knit in forming the course C-8 so that the held stitch loops are released and a one-by-one rib fabric is again produced at the upper end of the lower tubular body section 14. The alternate wales W-2 and W-4 preferably each comprise a single inwardly facing stitch loop L as illustrated, and the intervening wales W-1 and W-3 each comprise at least three, and preferably between about three to eight courses of outwardly facing stitch loops. The held stitch loops L draw the courses of plain stitch loops together to form the outwardly bulging nature of the annular band 13. It will be understood that the length of the held loops L is exaggerated in FIG. 7 for clarity of illustration.

The knit cover 10 of the present invention has sufficient stretchability in both the horizontal and vertical, or coursewise and walewise, directions to conform to and fit a wide variety of shapes and sizes of beverage containers. The cover 10 may be economically produced on a circular knitting machine and may be economically shipped in a compact flat or folded condition, and readily stored by the user in a convenient manner where it will be ready for immediate use.

In the drawings and specification, there has been set forth the best mode presently contemplated for the practice of the present invention, and although specific terms are employed, they are used in a generic and descriptive sense only and not for purposes of limitation, the scope of the invention being defined in the claims.

That is which is claimed is:

1. A knit cover for receiving a beverage container comprising a knit sleeve of successive courses knit of yarn having inherent heat insulating properties, and comprising:

an upper tubular knit section having an upper opening;

an outwardly bulging hang engageable annular band encircling said sleeve and being integrally knit with the lower end of said upper tubular section, said outwardly bulging band including held stitch loops and a plurality of courses of outwardly facing stitch loops positioned between said held stitch loops, said band aiding in preventing slipping of the cover through the hand of the holder of a beverage container received therein; and a lower tubular knit section having an upper portion integrally knit with the lower end of said band, said lower tubular section including a bottom portion having a lower opening of a diameter less than the diameter of the remaining portions of said sleeve, and such that the bottom portion is adapted to underlie the flat bottom of a beverage container received in the sleeve.

2. A knit cover according to claim 1 wherein said knit sleeve is seamless and is rib knit in a one-by-one pattern.

3. A knit cover according to claim 1 wherein said outwardly bulging band includes at least three courses knit with outwardly facing stitch loops.

4. A knit cover according to claim 1 wherein said upper opening is defined by an inlaid elastic yarn.

5. A knit cover according to claim 1 wherein said outwardly bulging band is spaced from the upper opening a distance between about one third to one fourth of the overall length of the sleeve.

6. A knit cover for receiving a beverage container comprising a seamless rib knit sleeve of successive courses knit of yarn having inherent heat insulating properties, and comprising:

an upper tubular knit section including an upper selvage opening with elastic yarn incorporated therein, an outwardly bulging hand engagable annular band encircling said sleeve and being integrally knit with the lower end of said upper tubular section, said band including alternate wales of inwardly facing held stitch loops, and intervening wales of a plurality of courses of outwardly facing stitch loops, and a lower tubular knit section having an upper portion integrally knit with the lower end of said band, said lower tubular section including a bottom portion having a circular restricted opening of a diameter less than the diameter of the remaining portions of said sleeve, and such that the bottom portion is adapted to underlie the flat bottom of a beverage container received in the sleeve.

7. A knit cover according to claim 6 wherein said restricted opening is substantially non-elastic.

8. A knit cover according to claim 7 wherein said alternate wales each comprise a single inwardly facing held stitch loop, and said intervening wales each comprise between about three to eight courses of outwardly facing stitch loops.

9. A knit cover according to claim 8 wherein said sleeve has an overall length of between about six to seven inches and said outwardly bulging band is spaced from the upper opening a distance between about one third to one fourth of the overall length of the sleeve.

* * * * *